United States Patent [19]

Nesseth

[11] 4,200,948

[45] May 6, 1980

[54] PAINT SCRAPER

[76] Inventor: Arthur E. Nesseth, Komoka, Ontario, Canada

[21] Appl. No.: 24,633

[22] Filed: Mar. 28, 1979

[51] Int. Cl.[2] ..... A47L 17/06

[52] U.S. Cl. ..... 15/236 R; 15/105

[58] Field of Search ..... 15/105, 121, 236 R, 15/236 A, 237, 244 R; 401/261, 266; 30/169–191

[56] References Cited

U.S. PATENT DOCUMENTS

| | | | |
|---|---|---|---|
| 3,250,000 | 5/1966 | Schumann | 30/171 |
| 3,530,524 | 9/1970 | Clemans | 15/236 R |
| 3,789,450 | 2/1974 | Mozdenski et al. | 15/105 |
| 3,795,026 | 3/1974 | Kazamek et al. | 15/236 R |
| 4,124,915 | 11/1978 | Schlicher | 15/105 |

FOREIGN PATENT DOCUMENTS

| | | | |
|---|---|---|---|
| 599715 | 6/1960 | Canada | 15/236 R |

*Primary Examiner*—Leonard D. Christian
*Attorney, Agent, or Firm*—Hirons, Rogers & Scott

[57] ABSTRACT

A paint scraper has a blade holding portion, having a slot in which is releasably mounted a paint scraper blade. The blade has a pair of different, opposed paint scraping edges. The first edge is straight and smooth, and is used for fine scraping work. The second is toothed, serrated and is used for coarse scraping work. The blade is readily removed from the slot and reversed or replaced, to change from one mode of operation to another.

5 Claims, 4 Drawing Figures

PAINT SCRAPER

FIELD OF THE INVENTION

This invention relates to paint scrapers, primarily for individual, domestic use.

BACKGROUND OF THE INVENTION AND PRIOR ART

The scraping of paint is a tedious, difficult and time consuming operation for the home decorator, which is often left incomplete or improperly done. Failure to remove properly an underlying, perviously applied coat of paint from a surface, prior to applying new paint thereto, often spoils the quality of the newly applied paint coating. Nevertheless, because the act of scraping off or otherwise removing old paint is tedious and difficult, there is strong inclination on the part of the home decorator not to finish this task to a sufficient degree.

The traditional paint scraper, comprising a relatively flexible blade permanently secured to a handle, is cumbersome to use and is not of great efficiency. It has only one blade, which must be used on all kinds and types of surfaces. Paint scrapers differ from one another generally only in their overall shape and in their width. Moreover, since they only have one scraping edge, they must discarded as useless as soon as that one edge is no longer effective.

SUMMARY OF THE INVENTION

It is an object of the present invention to provide a novel paint scraper.

It is a further object of the invention to provide a novel paint scraper with a removable and replaceable blade, providing different scraping surfaces.

The present invention provides a paint scraper in which a blade is releasably mounted in a slot extending substantially across one end edge of the paint scraper. The blade has two different scraping surfaces on opposed sides thereof, namely a smooth scraping surface and a serrated scraping surface. For the scraping of coarse work, the serrated edge of the blade is used and applied to the paint surface. When it is required to switch to the scraping of fine work, to remove the last traces of paint and otherwise finely prepare the surface for subsequent application of new coats of paint, the blade is removed, reversed, and reinserted in the slot in the paint scraper, so that the smooth edge protrudes from the end thereof for application to the surface. Such a paint scraper is simple and cheap to manufacture, versatile and simple to use. It provides added degrees of efficiency to the paint scraping operation for the home decorator. New blades can be obtained and used with the same holder once the first blade has become worn out. The choice of type of scraping edge, according to the type of work to be done, enables the paint scraping task to be completed more efficiently and rapidly, with better overall results.

BRIEF REFERENCE TO THE DRAWINGS

DESCRIPTION OF THE PREFERRED EMBODIMENTS

Figure 1:
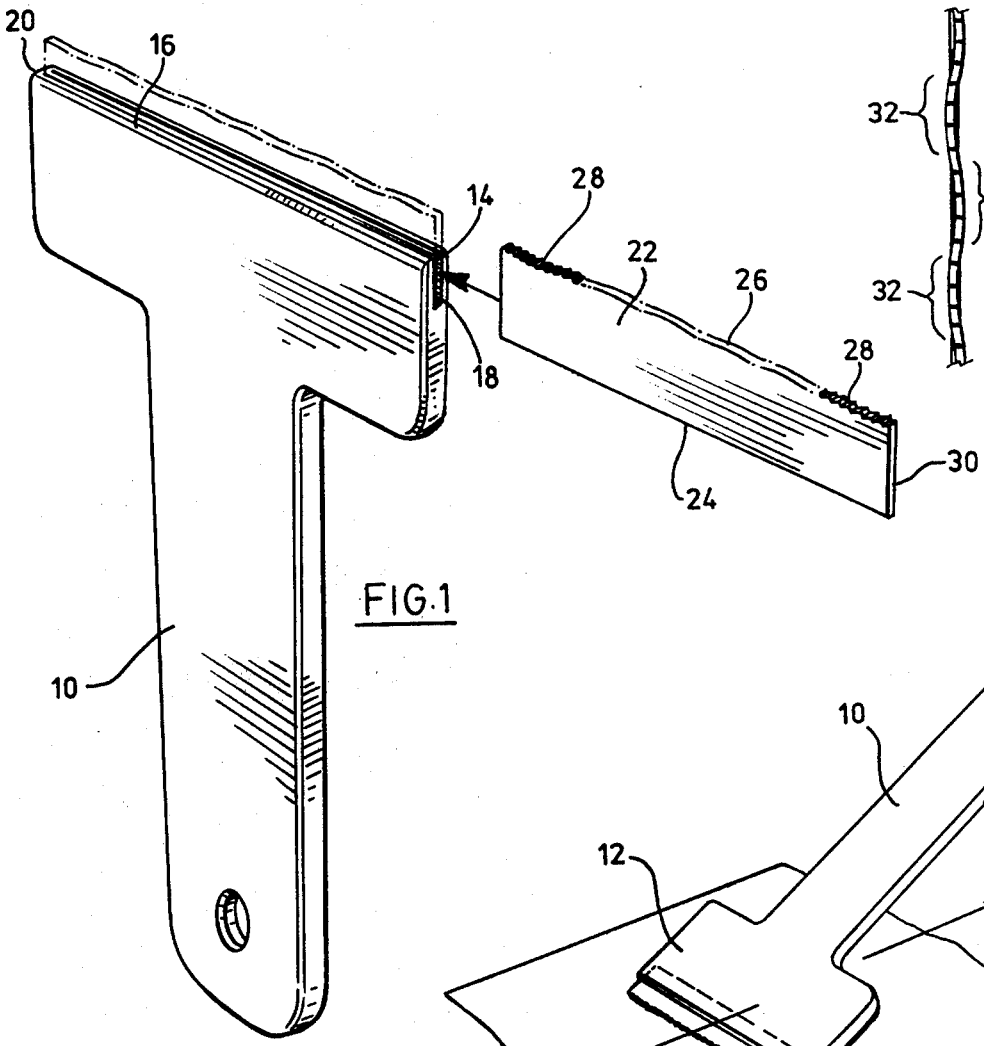
FIG. 1 is a perspective view of the paint scraper according to the invention, with the blade removed but ready for insertion.

Preferably, the blade is an interference fit in the blade receiving slot. When the paint scraper body is made of metal, the slot may extend the full width of the scraper, with open ends therein, so that the blade may be inserted from either side of the slot or from the longitudinal end thereof. When the scraper body is made of wood or plastic, however, it is preferred to leave one blind end on the slot, for more positive location of the blade within the slot.

Preferably also, the teeth on the serrated edge of the blade are triangular in section, but with unequal triangle sides so that the sharp, scraping apexes of the triangles are offset from the bases of the triangles of the teeth, all in the same sense, towards one edge of the blade. Also, it is preferred to provide groups of such teeth, adjacent groups thereof being displaced from the plane of the flat blade in opposite senses. In this way, an efficient, coarse scraping surface is provided on one edge of the blade, which will speed up the scraping process and render it more efficient, even on very coarse surfaces requiring the removal of old paint. For different effects, the operator can reverse the scraper, or remove the blade and turn it around with the teeth still protruding from the slot, so that the teeth are then angled differently towards the work surface in the subsequent operation. This structure of the apparatus provides for enhanced flexibility and versatility in these thereof.

DETAILED DESCRIPTION OF THE SPECIFIC PREFERRED EMBODIMENT

The paint scraper as illustrated is generally flat and comprises an elongated handle portion 10 and an integral blade holding portion 12 at one end of the handle 10. The blade holding portion 12 is wider than the handle 10 so that the paint scraper is of overall T-shape in front elevation. A blade receiving slot 14 extends across the width of the end edge 16 of the blade holding portion 12. The slot 14 is open at one lateral side 18 and closed at the opposed lateral side 20. The slot thus presents an open mouth end wise of the blade holding portion 12 and to one lateral side thereof, for loading purposes.

The scraper blade 22 is a generally planar, flat metal strip, releasably received as an interference fit in the slot 14. It has a first longitudinal scraping edge 24 of straight, generally smooth configuration. It has also a second longitudinal scraping edge 26, opposed to the first edge 24, which is serrated, provided with triangular section teeth 28. As shown in FIG. 1, the teeth 28 have their sharp end edges (or triangle apexes) offset from the triangle bases, all in the same sense, towards lateral side 30 of blade 22. The blade 22 is not therefore symmetrical about the longitudinal center line of the scraper, and different scraping effects are obtainable by turning the blade 22 around its slot 18, with the teeth presented outwardly.

Figure 4:
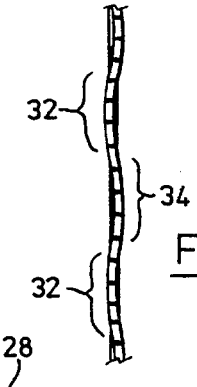
FIG. 4 is an edge view of the scraper blade of the paint scraper of FIGS. 1–3.
Figure 2:
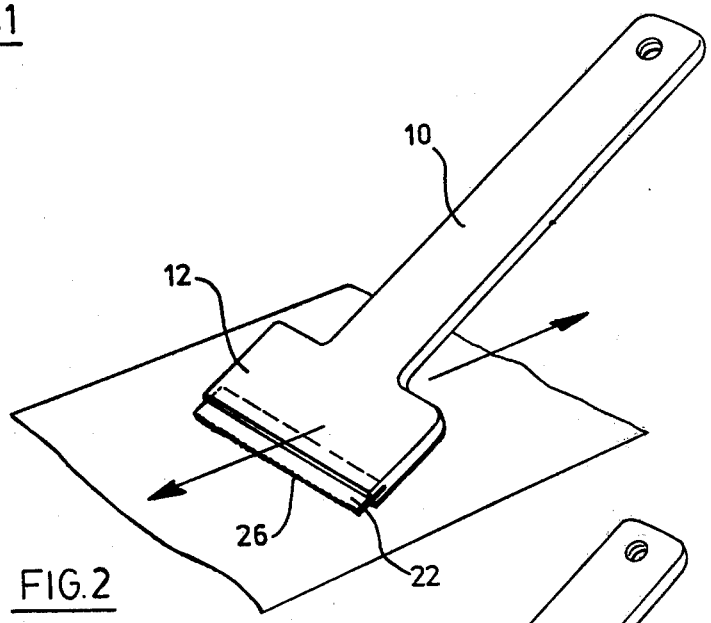
FIG. 2 is a perspective view of the paint scraper of FIG. 1 in a first mode of operation.
Figure 3:
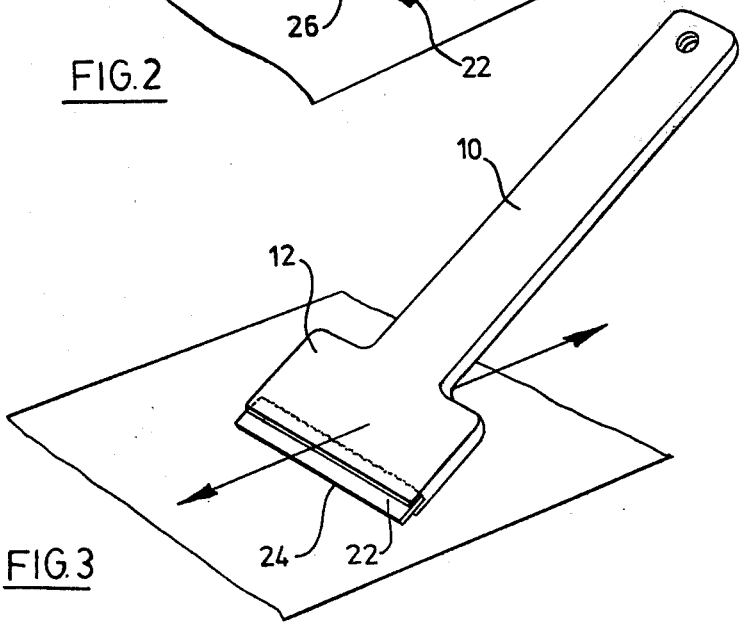
FIG. 3 is a view similar to FIG. 2 with the paint scraper in a second mode of operation.

As shown in FIG. 4, the teeth 28 are grouped into groups which are displaced from the general plane of the flat plate in alternate directions. Thus a first group 32 of teeth 28 are displaced in one direction from the plane of the plate 22. This group is followed by a second group 34 of teeth displaced in the opposite direction, then another first group 32 displaced in the other direction, and so on.

the paint scraper is capable of operation in three different modes, depending upon the nature of the work to be done. Firstly, when coarse work is to be done, e.g. the coarse removal of large quantities of paint from a surface such as paint in several thicknesses, the blade may be mounted in the slot with the serrated edge 26 protruding for use, as shown in FIG. 2. With the blade 22 mounted so that the teeth 28 are offset to the right, the right handed worker is able to conduct powerful but coarse scraping of a surface. The effectiveness of the coarse scraping is enhanced by the alternate lateral offset of the adjacent groups of teeth. For a medium coarseness of scraping, the right handed workman need only reverse the blade 22 to have the teeth 28 protruding and offset to the left, or alternatively turn over the scraper if its shape and the working location so permits. For the lefthanded workman, the positions of coarse and medium scraping are reversed. For fine, finishing scraping, the blade 22 is removed from slot 14 and replaced with smooth scraping edge 24 protruding for use, as shown in FIG. 3. In this manner, an exceptionally effective and efficient paint scraping task is accomplished, rapidly and with reduced effort.

The handle and blade holding portions of the paint scraper according to the invention may be manufactured of any suitable material offering suitable durability and rigidity, e.g. wood, metal or plastic. When the blade holding portion is made of metal, the blade holding slot may by open at both lateral ends and the blade still held sufficiently firmly but releasably therein. When the blade holding portion is of plastic or wood, however, a single blind ended slot as illustrated is preferred. A single handle and holding portion will of course generally outlast several such blades, and can be used with replacement blades long after the initial blade has been worn out and discarded.

Whilst a specific preferred embodiment of the invention has been shown and illustrated herein, the invention is not to be construed as limited thereto, and variations and modifications thereof will occur to those skilled in the art. The scope of the present invention is limited only by the scope of the appended claims.

I claim:

1. A paint scraper comprising a handle portion and a blade holding portion, said blade holding portion having an elongated blade receiving slot extending along at least a major portion of the width of said blade holding portion, with an open mouth of said slot presented along the end of the blade holding portion;

a scraper blade having a first scraping edge of straight, generally smooth configuration, and a second, opposed scraping edge of toothed, serrated configuration;

said scraper blade being adapted to be releasably received in said slot in a first position in which the first scraping edge of said blade protrudes beyond the mouth of said slot and beyond the end of the blade holding portion, and in a second position in which the second scraping edge of said blade protrudes beyond the mouth of said slot and beyond the end of the blade holding portion.

2. The paint scraper of claim 1 wherein the blade is an interference fit in the blade receiving slot.

3. The paint scraper of claim 2 wherein the second said scraping edge of the blade comprises triangular section teeth, the apexes of the triangles thereof being offset from the respective triangular base in the same sense towards one side edge of the blade.

4. The paint scraper of claim 3 wherein the blade is a generally flat, planar strip, the teeth of said scraping edge of the blade being grouped into groups of alternate first offset teeth and second offset teeth, the groups of first offset teeth being displaced from the plane of the blade in an opposite direction from the displacement of the groups of second offset teeth.

5. The paint scraper of claim 4 wherein the blade receiving slot has one open end and one closed end at opposed sides of the blade holding portion.

* * * * *